United States Patent [19]

Guerette

[11] Patent Number: 4,587,916

[45] Date of Patent: May 13, 1986

[54] DEVICE FOR FIXING THE WISH-BONE OF THE SAIL-BOARD TO THE MAST IN A FAST AND RIGID MANNER

[76] Inventor: Normand Guerette, 9917 Cobourg, Montreal Nord Quebec, Canada, H1H 4W5

[21] Appl. No.: 663,209

[22] Filed: Oct. 22, 1984

[30] Foreign Application Priority Data

Jan. 16, 1984 [FR] France ..... 84 00769
Jun. 25, 1984 [FR] France ..... 84 10190

[51] Int. Cl.[4] ..... B63H 9/00
[52] U.S. Cl. ..... 114/39; 114/98
[58] Field of Search ..... 114/39.1, 39.2, 89–91, 114/97–99; 248/74.1, 74.3, 231

[56] References Cited

U.S. PATENT DOCUMENTS

| | | | |
|---|---|---|---|
| 2,632,217 | 3/1953 | Flora | 248/74.3 |
| 3,913,187 | 10/1975 | Okuda | 248/74.3 |
| 4,334,488 | 6/1982 | Jolivet | 114/97 |
| 4,382,570 | 5/1983 | Craig | 248/74.3 |
| 4,424,759 | 1/1984 | Dolence | 114/98 |
| 4,448,142 | 5/1984 | Pollard | 114/39.2 |

FOREIGN PATENT DOCUMENTS

| | | | |
|---|---|---|---|
| 3030077 | 3/1982 | Fed. Rep. of Germany . | |
| 3100624 | 8/1982 | Fed. Rep. of Germany . | |
| 2423391 | 11/1979 | France . | |
| 2511647 | 2/1983 | France . | |
| 3224848 | 1/1984 | France . | |
| 2105280 | 3/1983 | United Kingdom | 114/39.2 |

*Primary Examiner*—Sherman D. Basinger
*Assistant Examiner*—Stephen P. Avila
*Attorney, Agent, or Firm*—Robic, Robic & Ass.

[57] ABSTRACT

A device for fixing the wish-bone of a sail-board to the mast of this sail-board in a fast and easy manner. The device comprises a U-shaped element intended to be connected to the mast, this element having two sleeve-shaped ends in which are inserted both arms of the wish-bone. A column-shaped, mast-engaging body is provided to connect the U-shaped element to the mast. This body has a bearing surface against which the mast may engage. A lever-operated, hook-clamping system is mounted on both sides of the bearing surface of the body to fix this body to the mast after the mast has been positioned against the bearing surface, such a fixation providing the requested connecting of the U-shaped element and wish-bone attached thereto to the mast. This device is particularly interesting in that it considerably simplifies the relatively delicate installation of the wish-bone onto the mast of a sail-board.

13 Claims, 9 Drawing Figures

DEVICE FOR FIXING THE WISH-BONE OF THE SAIL-BOARD TO THE MAST IN A FAST AND RIGID MANNER

BACKGROUND OF THE INVENTION (a) Field of the Invention

The present invention relates to a device for fixing the wish-bone of a sail-board to the mast of this sail-board in a fast and easy manner.

(b) Brief Description of the Prior Art

A problem well known to those familiar with sail-boarding is to connect the U-shaped element supporting the ends of the arms of the wish-bone to the mast of their sail-board. Generally, this U-shaped element has two sleeve-shaped ends in which are inserted and rigidly hold the ends of both arms of the wish-bone. This element also comprises a handle. When the sail-board is assembled, this element must be fixed to the mast as rigidly as possible. Indeed, it is well known that the more this fixation is rigid, the more the sail-boarder may control the position of his or her mast and therefore control the direction of the board with the wish-bone.

In most of the existing sail-boards, the system provided for fixing the rigid body holding the arms of the wish-bone to the mast, consists of a mere piece of rope that must be winded up and tightened around the mast and subsequently to the U-shaped element itself or to the handle forming part thereof.

Whatever be the design of the U-shaped element supporting the wish-bone, the fixation of the piece of rope is rather delicate and requests skill and physical strength from the sail-boarder if he or she wants the wish-bone to be very rigidly connected to the mast of the sail-board.

SUMMARY OF THE INVENTION

The object of the present invention is to provide a device for fixing the wish-bone of a sail-board to the mast of this sail-board, which device solves the above mentioned problem.

More particularly, the object of the present the invention is to provide a device which allows fixation of the wish-bone at any desired height onto the mast of a sail-board, in a very simple and rigid manner.

The device according to the invention is of the type comprising a U-shaped element intended to be connected to the mast, this element having two sleeve-shaped ends in which are inserted both arms of the wish-bone.

In accordance with the invention, this device is characterized in that it further comprises a column-shaped, mast engaging body provided with a bearing surface which may be positioned onto the mast. The U-shaped element and the wish-bone attached attached thereto are connected onto this mast engaging body which is provided with a lever-operated, hook-clamping system to fix it in a fast and easy manner to the mast after the same has been positioned against the bearing surface. This fixation of the mast engaging body of course resulting in a fast and easy fixation of the U-shaped element and of the wish-bone attached thereto to the mast.

In accordance with a first preferred embodiment of the invention, the U-shaped element is rigidly connected to the mast engaging body. In this particular case, the U-shaped element and the mast-engaging body may advantageously be molded together into one single piece.

In accordance with another preferred embodiment of the invention, the sleeve-shaped ends of the U-shaped element are connected to each other by a transversal piece and the U-shaped element is pivotably connected to the mast engaging body by mere engagement of its transversal piece into a preferably L-shaped, transversal groove provided in the mast engaging body. In this particular case the transversal piece acts as a rotational axis for the U-shaped element, this axis being particular to the mast and allowing adjustment of the angle made between the wish-bone and this mast.

In both of the preferred embodiments referred to herein above, the lever-operated, hook-clamping system of the device according to the invention preferably comprises:

a lever support fixed to the mast engaging body close to one side of the bearing surface of said body;

a lever mounted about a pivot on this support, said pivot having an axis substantially parallel to the mast when the same engages the bearing surface;

a strap having one end free and the other end mounted about a pivot onto the lever at a short distance from the pivot of this lever, the pivot of this strap being parallel to the one of said lever, said strap further having a length sufficient to pass around the mast when the same engages the bearing surface; and a hook-clamping device connected to the mast engaging body close to the other side of the bearing surface, for receiving and retaining the free end of the strap when this strap is passed around the mast with said mast engaging against the bearing surface.

With such a lever-operated, hook-clamping system, the fixation of the mast engaging body onto the mast can be made in a very simple manner, by merely tensioning the belt using the lever to do so after this belt has been engaged in the hook-clamping device. The lever is itself positioned so as to remain in a dead position after the tension has been exerted.

As can be easily understood, the device according to the invention is particularly interesting in that it provides very simple and easy fixation of the wish-bone to the mast of a sail-board at any desired height, by mere operation of a hook-clamping system as simple and easier to operate as the hook clamping systems currently used on ski-boots or skates.

BRIEF DESCRIPTION OF THE DRAWINGS

The invention and its various advantages will be better understood upon reading of the following non restrictive description of two preferred embodiments thereof, made with reference to the accompanying drawings in which.

DESCRIPTION OF A PREFERRED EMBODIMENT

Figure 1:
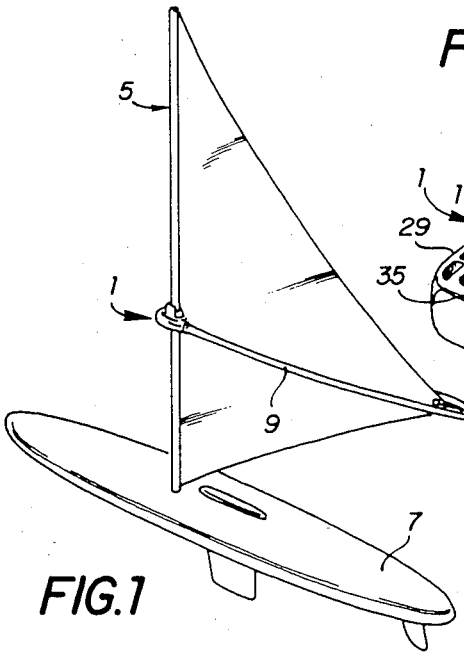
FIG. 1 is a schematic view of a sail-board provided with a device according to the invention for fixing the wish-bond to the mast.

The device 1 according to the invention as shown in FIGS. 1 to 4, is intended to be used for fixing in a fast and rigid manner the wish-bone 3 of a sail-board 7 to the mast 5 thereof. As shown in greater details in FIGS. 2 to 4, the device 1 comprises a U-shaped element 11 intended to be connected to the mast 5, at any desired height thereof.

The U-shaped element 11 comprises a pair of arms integrally extended by a pair of sleeves 13 and 15. These sleeves are intended to receive and rigidly hold the ends of the arms 9 and 9' of the wish-bone 3. The sleeves 13 and 15 may have a circular cross-section or an oval cross-section depending on the shape given by a sail-board manufacturer to the arms 9 and 9' of the wish-bone 3. In order to facilitate installation of the arms 9 and 9', holes 17 and 19 may be provided in the sleeves for receiving screws or any other means of the same type to ensure proper fixation of the ends of the arms of the wish-bone inside the sleeves 13 and 15.

Figure 2:
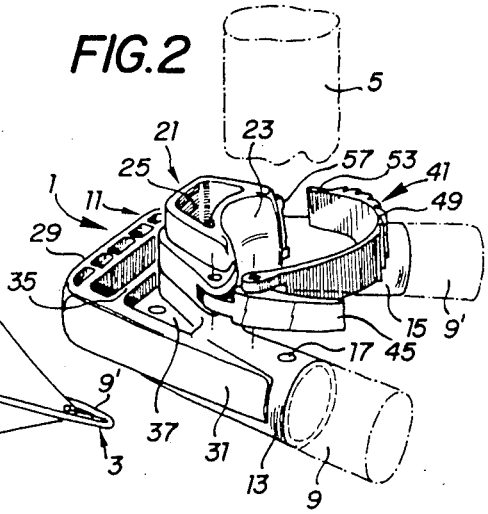
FIG. 2 is a perspective view of a first embodiment of the fixation device according to the invention.
Figure 3:
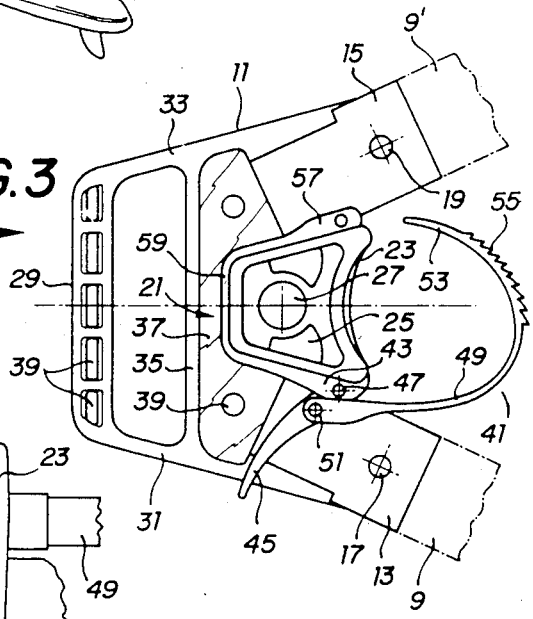
FIG. 3 is a top plan view of the device shown in FIG. 2.
Figure 4:
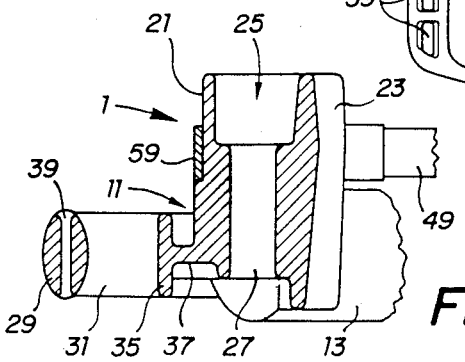
FIG. 4 is a side elevational view in cross-section of the device shown in FIGS. 2 and 3.

The device 1 also comprises a mast engaging body 21 rigidly connected to the U-shaped element 11. The mast engaging body 21 in the shape of a vertical column centrally positioned between the sleeves 13 and 15 from which it extends upwardly. The column-shaped body 21 has a substantially trapezoidal cross-section, with the larger parallel side of the trapezium positioned on the same side as the openings of the sleeves. The larger side 23 of the trapezium is concave and forms a bearing surface which can be positioned onto the external surface of the mast 5. As clearly shown in FIGS. 2 to 4, the sleeves 13 and 15 extend at angle from both sides of the column-shaped body in the lower part thereof. As also shown in FIGS. 2 to 4, the central body 21 is particularly hollowed out at 25 and comprises a central hole 27 opened at both ends. The hole 27 extends in a direction parallel to the mast when the device 1 is fixed thereto. The main utility of the hollowed portion 25 of the rigid body is to reduce as much as possible the total weight of the device 1. The utility of the hole 27 is to allow introduction and fixation of a rope, such as the one used for lifting up the mast, the wish-bone and the sail connected thereto when these elements are down and float onto the water surface.

As clearly shown in FIGS. 1 to 4, the transversal bar of the U-shaped element 11 of the device 1 defines a handle 29 extending in the same plane as the sleeves 13 and 15 in a direction opposite to these sleeves with respect to the column-shaped body 21. The ends 31 and 33 of this handle 29 define a pair of ribs that bear onto the external surfaces of the sleeves 13 and 15 and reinforce the same. A transversal rib 35 and a solid, reinforcing surface 37 may be provided between the ends 31 and 33 of the handle behind the sleeves 33 and 35 of the column 21, for making the U-shaped element and body assembly much more compact and rigid. Once again, holes 39 may be provided in the handle 29 as well as in the reinforcing surface 37 for making the device much lighter while simultaneously allowing drainage of its recessed portions.

The U-shaped element 11 as well as the column shaped body 21 are preferably made from a plastic material such as ABS of polypropylene. In practice, these element 11 and body 21 defining together the sleeves 13 and 15, the column 21 and the handle 29 may be molded in one single piece.

According to the invenion, the mast engaging body 21 of the device 1 acts as a support for a lever-operated, hook clamping system 41, especially designed for allowing rapid fixation of the body 21 directed onto the mast when the same bears against the bearing surface 23, this rapid fixation ensuring in turn rigid fixation of the U-shaped element 11 and of the wish-bone 3 connected thereto directly onto the mast.

As shown in FIGS. 2 to 4, the lever-operated, hook clamping system 41 comprises a lever support 43 fixed to the body 21 close to one side of the bearing surface 23. A lever 45 is mounted onto the support 43 about a pivot 47 having an axis substantially parallel to the mast when the same is engaged against the bearing surface 23. A strap 49 is mounted by one of its ends to the lever 45, about a pivot 51 located at a short distance from the pivot 47. The pivot 51 has an axis parallel to the axis of the pivot 47 and is positioned so as to extend behind this pivot 49 when the lever 45 is pushed against the column 21 in such a manner that the lever remains in a dead position after it has been so pushed. The strap 49 has a length sufficient to pass around the mast 5 when the same engages the bearing surface 23.

A hook clamping device 57 is connected to the body close to the other side of the bearing surface 23, for receiving and retaining the other, free end 53 of the strap when this strap is passed over the mast after the bearing surface 23 has been positioned onto this mast. The hook-clamping device 57 is preferably a pawl-and-ratchet mechanism cooperating with a plurality of teeth 55 provided over a portion of the length of the strap 49 close to its free end 53. The advantage of using such a pawl-and-ratchet mechanism lies in that it makes it easier to adjust the strap 49 to any kind of mast 5 of any thickness.

The lever support 43 and the hook-clamping device 59 can be fixed independently from each other to the body 21 above the sleeves 13 and 15, for allowing the strap 49 to pass around the mast. This fixation can be made with rivets or any similar means. However, according to a preferred embodiment of the invention, the lever support 43 and the hook clamping device 57 are preferably mounted at the ends of a stirrup 59 mounted onto the body 21 so as to extend all around the surface of this body opposite to the bearing surface 23, in order to provide a better distribution of forces when the clamping system is operated.

The use, the device 1 shown in FIGS. 1 to 4 is positioned against the mast 5 in such a manner that this mast engages the bearing surface 23. The free end 53 of the strap 49 is subsequently inserted into the hook-clamping device 57. Last of all, the lever 45 is operated from its original, opened position to a final, closed position where it contacts the surface of the column-shaped body 21, whereby a very simple, fast and rigid fixation of the device 1 and of the arms 9 and 9' of the wish-bone connected thereto is obtained onto the mast 5 of the sail-board.

Figure 5:
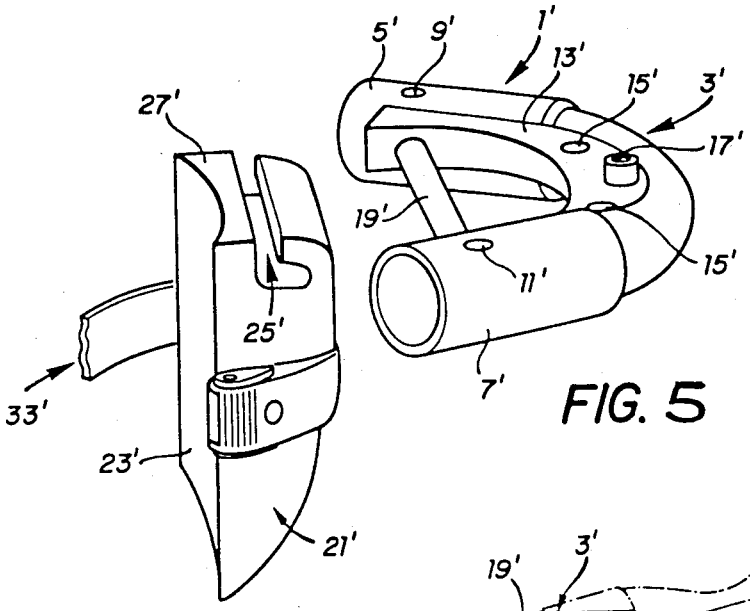
FIG. 5 is a perspective view of another embodiment of the fixation device according to the invention.
Figure 6:
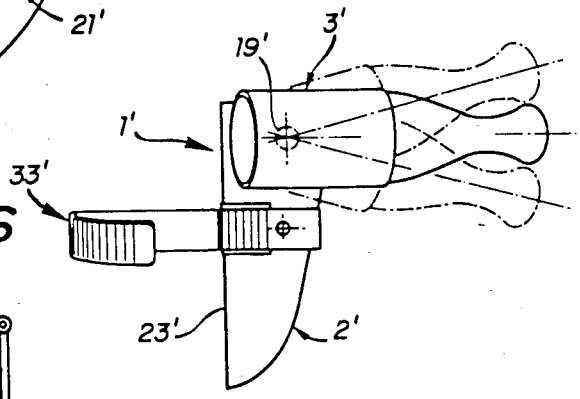
FIG. 6 is a side elevational view of the device shown in FIG. 5, illustrating the U-shaped element in different angular positions.
Figure 7A:
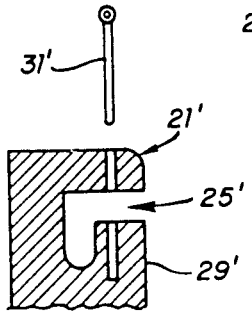
FIGS. 7*a* and 7*b* are cross-sectional views of the top portion of the mast engaging body of the device shown in FIGS. 5 and 6, illustrating alternative positions for the L-shaped groove used to connect the U-shaped element to the mast engaging body.
Figure 7B:
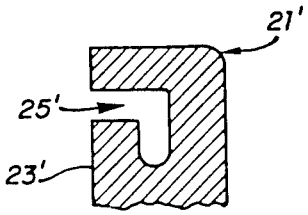
Figure 8:
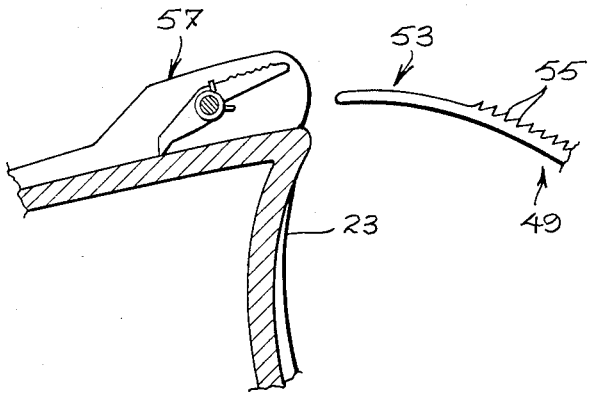
FIG. 8 is an enlarged, cross-sectional view of the hook-clamping device identified by reference numeral 57 in FIG. 3

The device 1' according to another embodiment of the invention as shown in FIGS. 5 to 7 differs from the device 1 shown in FIGS. 1 to 4 in htat that its U-shaped element 11' is pivotably mounted onto the mast-engaging body 21' instead of being rigidly connected thereto.

This other embodiment of the invention is based on the discovery that it is possible to substantially improve the versatility of the device according to the invention simply by leaving the sleeve-shaped ends of the U-shaped element 11' into which are inserted and rigidly hold the arms of the wish-bone, free to pivot in a vertical planes, that is about an axis perpendicular to the general axis of the mast. Indeed, it has been discovered that such a freedom given to the U-shaped element 11' makes it possible to use the device according to the invention with any kind of sail of any size and shape, and to adjust the angle between the wish-bone and the mast according to the requirement and/or experience of the sail-boarder. It has also been discovered that such a freedom given to the sleeve-shaped ends of the U-shaped element 11' to pivot, advantageously reduces the tensions that may undergo the lever-operated hook clamping system used for fixing the device to the mast, especially the pivots of the belt and of the pawl-and-rachet mechanism of this system.

As clearly shown in FIGS. 5 to 7, the device 1' comprises a U-shaped element 11' comprising a pair of arms integrally extended by a pair of sleeves 13' and 15' in which may be inserted and rigidly hold the ends of the arms of the wish-bone of a sail-board. The sleeves 13' and 15' may have a circular cross-section or an oval cross-section depending of the shape given the sail-board manufacturer to the arms of the wish-bone. In order to facilitate the installation of the arms of the wish-bone in the sleeves 13' and 15', holes 17' may be provided for receiving screws or any other fixation means.

The arms 13' and 15' and the transversal bar of the U-shaped element 11' may advantageously be reinforced by an internal rib 20'. The size and position of the rib 20' of course depend on the kind of plastic material used for the fabrication of the U-shaped element, and of the stiffness to be given to the element 11'. In order to reduce as much as possible the weight of this element, lighthening holes 39' can be provided in the rib 20' or in the element 11'.

A central trough-hole 22' may also be provided in the rib 20' to allow introduction and fixation of a rope like the one used for lifting up the mast, the wish-bone and the sail connected thereto when these elements are down and float onto the water surface.

As can be seen, the transversal bar of the U-shaped element 11' advantageously act in this particular case as a handle.

The arms 13' and 15' of the U-shaped element 11' are connected to each other close to their sleeve-shaped ends by a transversal piece 60 having a circular cross-section. The piece 60 extends in the same plane as the U-shaped element. For reinforcing purpose, the transversal piece 60 may advantageously be connected to the ends of the reinforcing ribs 20'.

The device 1' also comprises a mast-engaging body 21' intended to be used as a support for connecting the U-shaped element 11' to the mast of the sail-board. The body 21' which can be hollowed out at least in part to be as light as possible, preferably has a rectangular or trapezoidal cross-section, with the large side of the rectangle or trapezium positioned on the same size as the opening of the sleeves 13' and 15'. This large side 23' is preferably made concave to form a bearing surface which can be positioned onto the internal surface of the mast of the sail-board. The height of the body 21' is preferably selected to provide proper and stable contact between the device 1' and the mast of the sail-board.

A L-shaped groove 64 is provided in the body 21' for receiving the transversal piece 60 of the U-shaped element 11'. As shown in FIG. 5, this L-shaped groove 64 extends from the upper surface 62 of the element 11'. However, this groove may also extend from the rear surface 66 of the body, or alternatively from the concave front surface 23' of this body, as shown in FIGS. *7a* or *7b*. As previously indicated, the purpose of this groove 64 is to receive and hold the transversal piece 60 of the U-shaped element while allowing this U-shaped element to pivot about the axis of the transversal piece 75, as shown in FIG. 6. This freedom given to the U-shaped element to pivot in a vertical plane is particularly interesting in that it allow adjustment of the angle between the wish-bone and the mast of the said-board without generating tensions and without causing the body 21' to disengage the mast onto which is bears.

The L-shaped groove 64 must of course be selected in such a manner that the U-shaped element be easily positioned and held therein, preferably by mere gravity. In order to hold the transversal piece 60 in the bottom of the L-shaped groove 64, a locking pin 68 may be provided. As shown in FIG. *7a*, this pin 68 may be inserted in a transversal hole extending through the opening of the groove 64.

In orer to provide proper fixation of the device 1' including the U-shaped element 11' supporting the wish-bone and the body 21' to the mast of the sail-board, a lever-operated, hook clamping system 41' is provided. This system which is preferably mounted onto the body 21' under the U-shaped element 11', may be similar to the system 41 previously described.

The main advantage of the device 1' disclosed hereinabove is to permit the use of any kind of sail of any shape and design without generating tensions and stresses onto the body 21' or the hook clamping system 41'. Another advantage of this device 1' is to allow easy adjustment of the angle between the wish-bone and the mast depending of the requirement and experience of the sail-boarder.

Of course, numerous modifications can be made to each of the structural elements forming part of the device disclosed hereinabove, while following the general outlines of the invention as defined in the appended claims.

By way of example, a <<double>> device could be provided, wherein the body 21 or 21' would extend vertically up and down the surface of the U-shaped element 11 or 11' and would support two spaced-apart, lever-operated, hook-clamping systems 41 respectively mounted above and under the plane in which extend the sleeves 13 or 13' and 15 or 15'. This double device may be interesting when the sail-board is intended to be used under rough conditions (rough sea, competitions and the like).

Also by way of example, a similar device could be provided, wherein the sleeves 13 or 13' and 15 or 15' would not form an integral part of a U-shaped element but would instead be directly mounted in a rigid or pivotable manner on both lateral sides of the mast-engaging body 21 or 21'. This would lead to the same results, namely a fast and easy fixation of the device and the wish-bone attached thereto onto the mast of a sail-board.

What is claimed is:

1. A device for fixing the wish-bone of a sail-board to the mast of sail-board, said device comprising:

a U-shaped element intended to be connected to the mast, said U-shaped element having two sleeve-shaped ends into which are inserted both arms of the wish-bone;

a column-shaped, mast engaging body provided with a bearing surface which may be positioned onto the mast said mast engaging body being rigidly connected to the U-shaped element and forming therewith one single piece fixable to the mast; and a lever-operated, hook clamping system rigidly mounted on said mast engaging body to fix it in a fast and easy manner to the mast after said mast has been positioned onto the bearing surface;

said fixation of the mast engaging body resulting in a fast and easy fixation of the U-shaped element and of the wish-bone attached thereto to the mast, wherein said lever-operated, hook-clamping system comprises:

a lever support fixed to the mast engaging body close to one side of the bearing surface of said body;

a lever mounted about a pivot on this support, said pivot having an axis substantially parallel to the mast when the same engages the bearing surface;

a strap having one end free and the other end mounted about a pivot onto the lever at a short distance from the pivot of this lever, the pivot of said strap being parallel to the one of said lever, said strap having a length sufficient to pass around the mast when the same engages the bearing surface, and comprising a plurality of teeth over a portion of its length close to its free end; and a hook-clamping device connected to the mast engaging body close to the other side of the bearing surface for receiving and retaining the free end of the strap when this strap is passed around the mast with said mast engaged against the bearing surface, said hook-clamping device comprising a pawl urged against the teeth of the strap to engage the same;

said lever support and hook-clamping device being mounted at the ends of a stirrup mounted onto the mast engaging body so as to extend all around the surface of said body opposite to the bearing surface;

whereby the rigid body can be rigidly fixed onto the mast by merely tensioning the strap with the lever when this strap is engaged in the hook clamping device, said lever being positioned so as to remain in a dead position after the tension is exerted.

2. The device of claim 1 wherein the U-shaped element defines a handle extending in the same plane as the sleeves but in a direction opposite to said sleeves with respect to the mast-bearing body.

3. The device of claim 1 wherein the mast engaging body is hollowed out and comprises a central bore open at both ends, said bore being parallel to the mast.

4. The device of claim 3, wherein:

the mast engaging body has a substantially trapezoidal cross-section, the larger side of the trapezium being concave and forming the bearing surface;

the sleeves receiving the arms of the wish-bone extend at angle from both sides of the body in the lower part thereof; and the handle has ribs extending over the external surfaces of the sleeves to reinforce the same.

5. The device of claim 3, wherein the column-shaped body and the U-shaped element defining the sleeves and the handle are made of ABS or polypropylene plastic material and are molded into one single piece.

6. A device for fixing the wish-bone of a sail-board to the mast of said sail-board in a fast and easy manner, said device comprising:

a column-shaped, mast engaging body provided with a bearing surface which may be positioned onto the mast;

a U-shaped element comprising a transversal piece and a pair of sleeve-shaped ends into which are inserted both arms of the wish-bone, said U-shaped element being pivotably connected to said mast engaging body by engagement of its transversal piece into a transversal groove extending perpendicularly to the mast in said mast engaging body, said transversal piece acting as a rotational axis for the U-shaped element; and a lever-operated, hook clamping system rigidly mounted on said mast engaging body to fix it in a fast and easy manner to the mast after said mast has been positioned onto the bearing surface, said fixation of the mast engaging body resulting in a fast and easy fixation of the U-shaped element and of the wish-bone attached thereto to the mast, wherein said lever-operated, hook-clamping system comprises:

a lever support fixed to the mast engaging body close to one side of the bearing surface of said body;

a lever mounted about a pivot on this support, said pivot having an axis substantially parallel to the mast when the same engages the bearing surface;

a strap having one end free and the other end mounted about a pivot onto the lever at a short distance from the pivot of this lever, the pivot of said strap being parallel to the one of said lever, said strap further having a length sufficient to pass around the mast when the same engages the bearing surface, and comprising a plurality of teeth over a portion of its length close to its free end; and a hook-clamping device connected to the mast engaging body close to the other side of the bearing surface, for receiving and retaining the free end of the strap when this strap is passed around the mast with said mast engaged against the bearing surface, said hook-clamping device comprising a pawl urged against the teeth of the strap to engage the same;

said lever support and hook-clamping device being mounted at the ends of a stirrup mounted onto the mast engaging body so as to extend all around the surface of said body opposite to the bearing surface;

whereby the rigid body can be rigidly fixed onto the mast by merely tensioning the strap with the lever when this strap is engaged in the hook clamping device, said lever being positioned so as to remain in a dead position after the tension is exerted.

7. A device for fixing the wish-bone of a sail-board to the mast of said sail-board in a fast and easy manner, said device comprising:

a column-shaped, mast engaging body provided with a bearing surface which may be positioned onto the mast;

a U-shaped element comprising a transversal piece and a pair of sleeve-shaped ends into which are inserted both arms of the wish-bone, said U-shaped element being pivotably connected to said mast engaging body by engagement of its transversal piece into a transversal groove extending perpendicularly to the mast in said mast engaging body, said transversal piece acting as a rotational axis for the U-shaped element, said transversal groove in the mast engaging body being L-shaped in side elevational view; and a lever-operated, hook clamping system rigidly mounted on said mast engaging body to fix it in a fast and easy manner to the mast after said mast has been positioned onto the bearing surface, said fixation of the mast engaging body resulting in a fast and easy fixation of the U-shaped element and of the wish-bone attached thereto the mast, a said lever-operated, hook-clamping system comprising:

a lever support fixed to the mast engaging body close to one side of the bearing surface of said body;

a lever mounted about a pivot on this support, said pivot having an axis substantially parallel to the mas when the same engages the bearing surface;

a strap having one end free and the other end mounted about a pivot onto the lever at a short distance from the pivot of this lever, the pivot of said strap being parallel to the one of said lever, said strap further having a length sufficient to pass around the mast when the same engages the bearing surface and comprises a plurality of teeth over a portion of its length close to its free end; and a hook-clamping device connected to the mast engaging body close to the other side of the bearing surface, for receiving and retaining the free end of the strap when this strap is passed around the mast with said mast engaged against the bearing surface, said hook-clamping device comprising a pawl urged against the teeth of the strap to engage the same;

said lever support and hook-clamping device being mounted at the ends of a stirrup mounted onto the mast engaging body so as to extend all around the surface of said body opposite to the bearing surface;

whereby the rigid body can be rigidly fixed onto the mast by merely tensioning the strap with the lever when this strap is engaged in the hook-clamping device, said lever being positioned so as to remain in a dead position after the tension is exerted.

8. The device of claim 7, wherein the L-shaped groove is made in the surface of the mast engaging body which is opposite to its bearing surface.

9. The device of claim 7, wherein the L-shaped groove is made in the bearing surface of the mast engaging body.

10. The device of claim 7, wherein the L-shaped groove is made in the top surface of the mast engaging body.

11. The device of claim 7, wherein the column-shaped body and U-shaped element are each made of ABS or polypropylene pastic material.

12. A device for fixing the wish-bone of a sail-board to the mast of said sail-board in a fast and easy manner said device comprising:

(a) a column-shaped, mast engaging body provided with a bearing surface which may be positioned onto the mast, and with two lateral side;

(b) a pair of sleeves mounted on lateral sides of the mast engaging body, said sleeves being shaped to receive and hold the ends of the arms the wish-bone; and (c) a lever-operated, hook-clamping system to fix the mast engaging body in a fast and easy manner to the mast after said mast has been positioned onto the bearing surface, said fixation of the mast engaging body leading to a fast and easy fixation of the wish-bone to the mast, (d) wherein said lever-operated, hook-clamping system comprises:

a lever support fixed to the mast engaging body close to one side of the bearing surface of said body;

a lever mounted about a pivot on this support, said pivot having an axis substantially parallel to the mast when the same engages the bearing surface;

a strap having one end free and the other end mounted about a pivot onto the lever at a short distance from the pivot of this lever, the pivot of said strap being parallel to the one of said lever, said strap further having a length sufficient to pass around the mast when the same engages the bearing surface and comprising a plurality of teeth over a portion of its length close to its free end; and a hook-clamping device connected to the mast engaging body close to the other side of the bearing surface, for receiving and retaining the free end of the strap when this strap is passed around the mast with said mast engaged against the bearing surface, said hook-clamping device comprising a pawl urged against the teeth of the strap to engage the same;

said lever support and hook-clamping device being mounted at the ends of a stirrup mounted onto the mast engaging body so as to extend all around the surface of said body opposite to the bearing surface;

whereby the rigid body can be rigidly fixed onto the mast by merely tensioning the strap with the lever when this strap is engaged in the hook-clamping device, said lever being positioned so as to remain in a dead position after the tension is exerted.

13. The device of claim 12, wherein the sleeves into which are inserted the arms of the wish-bone are pivotably mounted onto the mast engaging body about an axis perpendicular to the mast.

* * * * *